US009068346B1

(12) United States Patent
Lu et al.

(10) Patent No.: US 9,068,346 B1
(45) Date of Patent: Jun. 30, 2015

(54) ACOUSTIC ATTENUATORS BASED ON POROUS NANOSTRUCTURED MATERIALS

(71) Applicants: The Board of Regents of the University of Texas System, Austin, TX (US); Rensselaer Polytechnic Institute, Troy, NY (US); The Curators of the University of Missouri, Columbia, MO (US)

(72) Inventors: Hongbing Lu, Plano, TX (US); Ning Xiang, Cohoes, NY (US); Nicholas Leventis, Rolla, MO (US); Chariklia Sotiriou-Leventis, Rolla, MO (US)

(73) Assignees: The Board of Regents of the University of Texas System, Austin, TX (US); Rensselaer Polytechnic Institute, Troy, NY (US); The Curators of the University of Missouri, Columbia, MO (US)

( * ) Notice: Subject to any disclaimer, the term of this patent is extended or adjusted under 35 U.S.C. 154(b) by 0 days.

(21) Appl. No.: 14/059,254

(22) Filed: Oct. 21, 2013

Related U.S. Application Data

(63) Continuation of application No. 13/969,350, filed on Aug. 16, 2013, now abandoned, which is a continuation-in-part of application No. 13/214,061, filed on Aug. 19, 2011.

(60) Provisional application No. 61/375,757, filed on Aug. 20, 2010, provisional application No. 61/683,741, filed on Aug. 16, 2012.

(51) Int. Cl.
*E04B 1/86* (2006.01)
*E04B 1/84* (2006.01)

(52) U.S. Cl.
CPC ..... *E04B 1/84* (2013.01)

(58) Field of Classification Search
CPC ..... E04B 1/86
USPC ..... 181/294
See application file for complete search history.

(56) References Cited

U.S. PATENT DOCUMENTS

| | | | | |
|---|---|---|---|---|
| 4,283,465 | A * | 8/1981 | Morimoto et al. | 428/566 |
| 4,828,932 | A * | 5/1989 | Morimoto et al. | 428/608 |
| 5,484,818 | A | 1/1996 | De Vos et al. | |
| 5,484,970 | A * | 1/1996 | Suzuki et al. | 181/294 |

(Continued)

FOREIGN PATENT DOCUMENTS

JP 1905158483 * 6/1993

OTHER PUBLICATIONS

A. Rigacci et al., Preparation of polyurethane-based aerogels and xerogels for thermal superinsulation, Journal of Non-Crystalline Solids, 350: 372-378 (2004).

*Primary Examiner* — Forrest M Phillips
(74) *Attorney, Agent, or Firm* — Winstead PC

(57) ABSTRACT

The invention is directed to a porous, acoustic attenuating composition, wherein the composition comprises a nanostructured material and wherein the composition exhibits acoustic transmission loss ranging from 20 to 60 dB/cm thickness of the composition.

17 Claims, 2 Drawing Sheets

(56) References Cited

U.S. PATENT DOCUMENTS

| | | | | |
|---|---|---|---|---|
| 5,869,545 | A | 2/1999 | Biesmans et al. | |
| 5,916,681 | A * | 6/1999 | Cipin | 428/403 |
| 6,007,890 | A * | 12/1999 | DeBlander | 428/72 |
| 6,596,389 | B1 * | 7/2003 | Hallett et al. | 428/317.9 |
| 8,461,223 | B2 | 6/2013 | Lee et al. | |
| 2006/0211840 | A1 | 9/2006 | Lee | |
| 2010/0330008 | A1 * | 12/2010 | Izu et al. | 424/59 |
| 2012/0152846 | A1 | 6/2012 | Leventis et al. | |

* cited by examiner

ACOUSTIC ATTENUATORS BASED ON POROUS NANOSTRUCTURED MATERIALS

CROSS-REFERENCE TO RELATED APPLICATIONS

This Application is a Continuation of application Ser. No. 13/969,350 filed on Aug. 16, 2012, which is a Continuation-in-part of application Ser. No. 13/214,061 filed on Aug. 19, 2011, which is fully incorporated by reference herein. Application Ser. No. 13/214,061 claims the benefit of U.S. Provisional Application No. 61/375,757 filed on Aug. 20, 2010, which is fully incorporated by reference. Application Ser. No. 13/969,350 claims the benefit of U.S. Provisional Application 61/683,741 filed on Aug. 16, 2012, which is fully incorporated by reference.

STATEMENT REGARDING FEDERALLY SPONSORED RESEARCH OR DEVELOPMENT

This invention was made with government support under Grant No. W911NF-10-1-0476 awarded by the Army Research Office and Grant Nos. CHE-0809562, DMR-0907291, CMMI-1031829, and CMMI-1132174 awarded by the National Science Foundation. The government has certain rights in the invention.

BACKGROUND OF THE INVENTION

Noise is produced by objects in vibration, and reducing noise to create quiet environments has been a goal in human civilizations. Noise are produced by many sources, including, but not limited to, vehicles on the road, airplanes (in flying, taking-off or landing such as on runway, aircraft carrier decks), machining processes (machining on lathe, grinding, sand blasting, etc.), appliance (washing machine, refrigerator, dishwasher, etc.), gunshots, and explosions to name a few. Exposure to noise can induce hearing loss. A long-time exposure to medium intensity sound in situations such as sand blaster operation, or a short time exposure to high intensity sound such as those induced by blast can induce irreversible hearing loss.

Significant endeavors have been made by materials science and acoustics experts for innovation of materials or hearing protection devices that produce noise attenuation, using single layer or multiple layers of materials in the design. In the current art, the primary sound insulation materials are microporous materials, such as polyurethane foams, the pores of which have dimensions on the order of tens of microns or higher. Noise is attenuated when sound travels through a torturous path, or through the walls with irregular shapes. The walls, however, are made of homogeneous materials with geometry changing continuously, so that the sound wave can travel through without much resistance. In addition, the pores are large so that sound can travel through the pores without much resistance. Since the entire foam is made of homogeneous skeletal material (FIG. 1), in which sound wave can travel freely from one location to another, the primary mechanism for attenuation of sound is the irregular geometry in porous walls that induce sound reflection, scattering, and diffraction, and its resulting torturous path, which is very limited. As a result, the sound attenuation loss when a sound transmits through a unit thickness of such materials is small, on the order of less than 5 dB/cm.

Traditional acoustic materials provide much lower sound transmission loss. In many critical applications, such as aerospace, aviation, defense applications, power plant, medical devices etc. noise control is a very challenging task. In order to achieve high transmission loss, either bulky or heavy materials have to be applied, even though, the sound transmission loss cannot be achieved as high as those critical applications require.

It would therefore be desirable to develop materials having better sound attenuation properties than those exhibited by currently available options. It is an object of the invention to provide a nanostructured material, which exhibits superior acoustic attenuation properties relative to prior art compositions. This invention provides low-cost, lightweight, thin-materials (panels or required curved shapes) which can provide high sound transmission loss as high as 40-70 dB or greater. Combining their excellent thermo-insulation and mechanical properties, this invention can be applied to many critical applications where the high sound transmission loss is required.

SUMMARY OF THE INVENTION

An embodiment of the invention is directed to an acoustic attenuating composition, wherein the composition comprises primary particles and secondary particles, wherein said secondary particles are composed of the primary particles and the composition contains pores ranging in size from a few nm to a few microns, and further wherein the composition exhibits acoustic transmission loss greater than 20 dB/cm thickness of the composition.

A further embodiment of the invention is directed to an acoustic attenuating composition that comprises a coating in which the secondary particles are embedded, wherein the coating comprises a polymer.

The above summary of the invention is not intended to represent each embodiment or every aspect of the present invention.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF ILLUSTRATIVE EMBODIMENTS OF THE INVENTION

Figure 1:
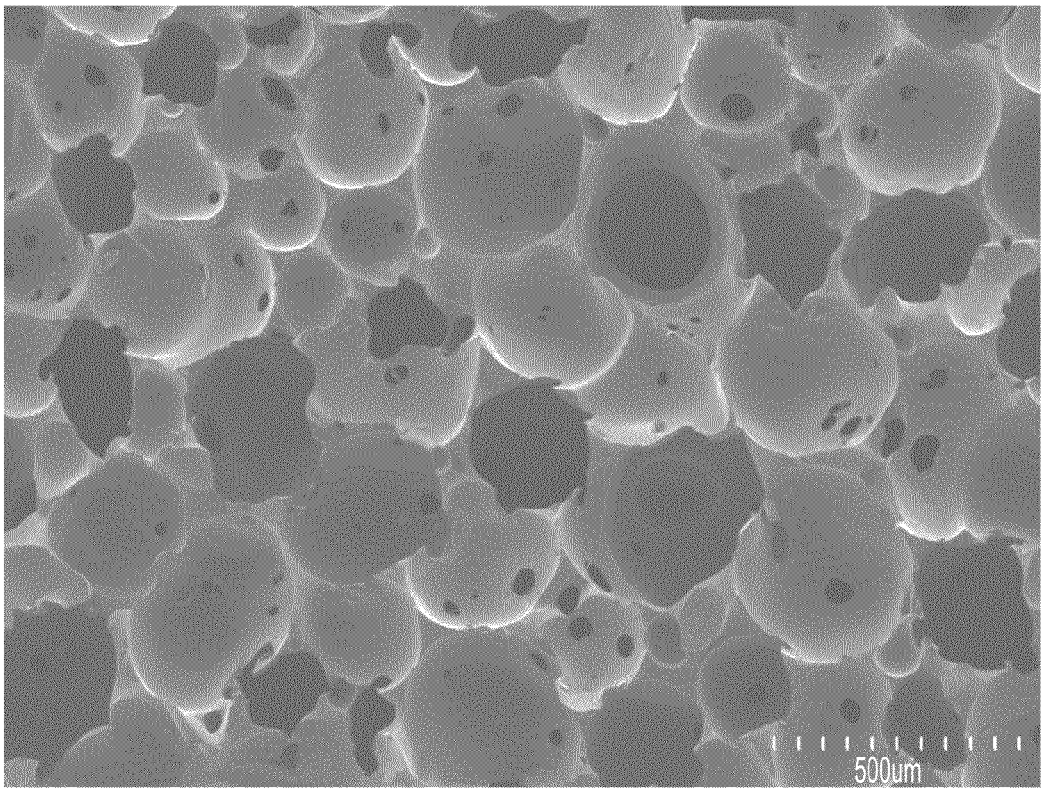
FIG. 1 is an SEM image of a prior art microporous foam.

Aspects of the claimed invention are directed to acoustic attenuators comprising nanostructured materials. In certain embodiments, the nanostructured materials comprise random hierarchical structures made of polymers or polymer composites in which one or more polymers are blended with inorganic components. The materials and structures of the acoustic attenuating compositions set forth herein, are highly heterogeneous. These hierarchical three-dimensional materials typically take the form of nanoparticles, nanofibers, nano platelets, or a combination of each of these. The basic building elements are nanoparticles (zero dimensional objects), nanowires (one-dimensional objects), or nanoplatelets (two-dimensional objects). These nanostructures are connected in a random network, forming pores with pore sizes ranging from less than 10 nm nanometers to more than one micron in diameter or thickness, and eventually to macroscales.

Aerogels are lightweight, porous nanostructured materials with exceptional thermal insulation properties. The most widely studied aerogel variety is based on silica; however, recent advances in all-polymer aerogels have resolved fragility issues and render them viable alternatives. In particular, polyurea aerogels can be synthesized in a single environmentally friendly step from inexpensive triisocyanates and water over a wide range of densities. Conventional materials with high acoustic damping capabilities typically are relatively heavy and/or bulky. In applications where weight and volume are at a premium, polyurea aerogels may potentially provide a solution where traditional materials fail. In contrast to traditional porous materials, polyurea aerogels demonstrate very high acoustic attenuation and therefore show promise for a wide range of applications.

In certain embodiments of the invention, the nanostructured materials are comprised of polymer and/or composites of polymers and metal oxides. The materials can be flexible or rigid depending on their intended use. Typically at low mass densities, the acoustic attenuators are flexible. At higher densities, the acoustic attenuators are rigid. The nanostructured materials of the claimed invention possess exceptional environmental stabilities. They can survive in water, and humidified environments and at temperatures from cryogenic temperatures (−180° C.) to a temperature typically 150° C. above glass transition temperatures of the materials.

The nanostructured materials of the claimed invention can be used as acoustic attenuators. Uses of these materials include earplugs, sound insulation material in earmuffs, flat or curved panels for use in building walls, vehicles bodies, aircraft (such as for fuselages, wings), or appliances (such as dish washers, washing machines, refrigerators, air conditioners) to insulate the noise from passing from one region to another.

In certain embodiments of the invention, the nanostructured materials of the claimed invention have a surface area greater than 50 $m^2/g$. In other embodiments of the invention, the nanostructured materials have a porosity greater than 50%.

The acoustic attenuators of the claimed inventions are objects with geometries, made of such multiscale porous nanostructured materials self-assembled from fractal nanoparticles, to generate a barrier between a noise source and an environment where noise levels are attenuated drastically. When sound waves travel through these acoustic attenuators, significant levels of noise are attenuated by multiscale porous nanostructured materials self-assembled from fractal nanoparticles. These materials include polymer nanoencapsulated silica aerogels, and purely organic aerogels with morphologies in the form of porous nanoparticulate and/or nanofibrous materials. The porous hierarchical structures facilitate direct interaction of propagating acoustic waves with nanostructures and pores which are highly heterogeneous in size, giving rise to a large number of interfaces among fractal building blocks of the materials, at which wave propagation is attenuated drastically. The hierarchical levels of mesopores spanning from nanometer to micron scales provide significant resistance to phonons as a result of highly tortured paths. The synergistic effect in attenuation provided by the nanostructured materials and pore sizes has displayed acoustic attenuation as high as 20-60 dB/cm of thickness of a material over the entire auditory frequency range. These superior acoustic attenuation properties have not been found in any other known acoustic materials thus far. The utilization of such materials is anticipated to assist to create quiet environments in spaces inhabited by humans and provide hearing protection.

In certain embodiments of the invention, the nanostructured materials are used as acoustic attenuators in a variety of noise-reducing applications. The higher noise attenuation properties of the nanostructured materials provide significant noise reduction using relatively thin materials, on the order of 1 cm or thinner.

The nanostructured materials of the claimed invention, also known as aerogels, display a wide range of dimensions, including those related to the pore size. In certain embodiments of the invention, the nanostructured materials comprise primary particles in the size ranging from 1-2 nm. These primary particles assemble to form secondary particles ranging in size from 15 nm to 2 microns. Thus, a typical nanostructured material of the claimed invention is composed of particles in the range of 15 nm to 2 microns, which in turn are formed by the assembly of nanoparticles ranging in size from 1-2 nm. In certain embodiments, the larger secondary particles are embedded in a network of nanofibers. The assembly of the primary nanoparticles to form larger particles and the assembly of the larger secondary particles to form a network creates pore sizes ranging from less than 10 nanometers to more than one micron in diameter or thickness. In certain embodiments of the invention, the assembly of the primary particles and the secondary particles creates a mesoporous material containing pores with diameters between 2 and 50 nm. This heterogeneity in particle size and pore size leads to mechanical properties in the nanostructured materials that are highly heterogeneous. In certain embodiments, the viscosity of the materials enhances the acoustic attenuation properties of the materials. In contrast to solid composites in which these heterogeneities are smeared out when a material responds to sound wave with relatively long wave lengths, these nano/microscale heterogeneities are suspended in mesoporous structures that interact directly with acoustic waves. The direct interactions of sound waves with nanostructures lead to new mechanisms in wave attenuations. When sound is applied to the incident face of an aerogel surface, part of the wave travels in the aerogel through the solid mesoporous structures, and part of the wave travels through the pores.

When a sound wave travels along the walls composed of a homogeneous material, at each juncture, the waves are partitioned based on the acoustic impedance. Prior to branching out, wave attenuates as the wave fronts become larger. The intensity of the transmitted wave will reduce during such transmission due to energy partition: the reflected wave carries part of the energy, and does not move with the transmitted wave. By the time when the reflected wave travels upstream towards the incident face, the transmitted wave has moved to next interface downstream. This indicates that the energy has been partitioned into two already. The transmitted wave is highly scattered due to propagation in heterogeneous porous nanostructures, and will carry less energy, and smaller amplitude, and thus lower sound intensity in its wave front.

However, this has to happen on every interface, and attenuation occurs at every interface, and because there are a large number of interfaces in the nanostructured materials, the incident large amplitude wave is broken up into smaller amplitude waves. By the time the sound waves traverse through all the interfaces, their amplitude becomes smaller exponentially with the number of interfaces the wave has to pass through. Additionally, they do not arrive at the rear face at the same time, and they all become smaller in amplitudes. The sound intensity, as a measure of the pressure magnitude of the collection of out-of-sync waves is significantly smaller than the amplitude of incident wave.

When a wave travels along a fiber as in the case of nanofibers in the attenuators, the fiber guides the wave propagation in one-dimensional mode. All aerogels under consideration contain an organic (i.e., polymeric) phase, such as polyurea or polymethylmethacrylate (PMMA), in its glassy state. In the case of polyurea (Tg=125° C.) it has been shown that molecular heterogeneity gives rise to local negative stiffness, as a result a wave cannot get transmitted. However, in solid bulk polyurea, those effects are smeared out, and in polyurea aerogels the polymer chains interact directly with the air molecules.

Silica primary particles have higher density than polyurea, and therefore can be considered as a sphere surrounded by a viscoelastic polyurea nanoshell and is embedded in somewhat less dense polyurea that fills the remaining empty space of the secondary particles. Silica/polyurea nanocore/shell composite can be considered as a mass-in-mass system supported by springs. As in the case of these aerogels, the secondary particles are composed of fractal network of assembly of nanoparticles. When incoming wave arrives, the mass-in-mass system tends to induce vibration or resonance to create acoustic waves with opposite phases to cancel with the incoming waves.

In addition, the nano/micro porous structures in these materials are random. When an acoustic wave travels in a random network of nanoparticles, the wave propagation path follows nearly a random walk in three dimensions. Under such situation, the radius at which the wave travels follows approximately a square root of the number of steps. Some waves might be able to go through the random three-dimensional nanostructures like a maze to the transmission face of the sample, some other waves, however, are returned to the incident face to contribute further to the sound attenuation.

As discussed previously, prior art sound insulation materials are primarily microporous materials, such as polyurethane foams, the pores of which have dimensions on the order of tens of microns or larger. FIG. 1 shows an SEM image for a representative prior art microporous foam material. As can be seen in FIG. 1, the pores are large so that the waves travel through the pores without much resistance. Microporous foams typically demonstrate sound attenuation losses on the order of less than 5 dB/cm, which is less than optimal.

Figure 2:
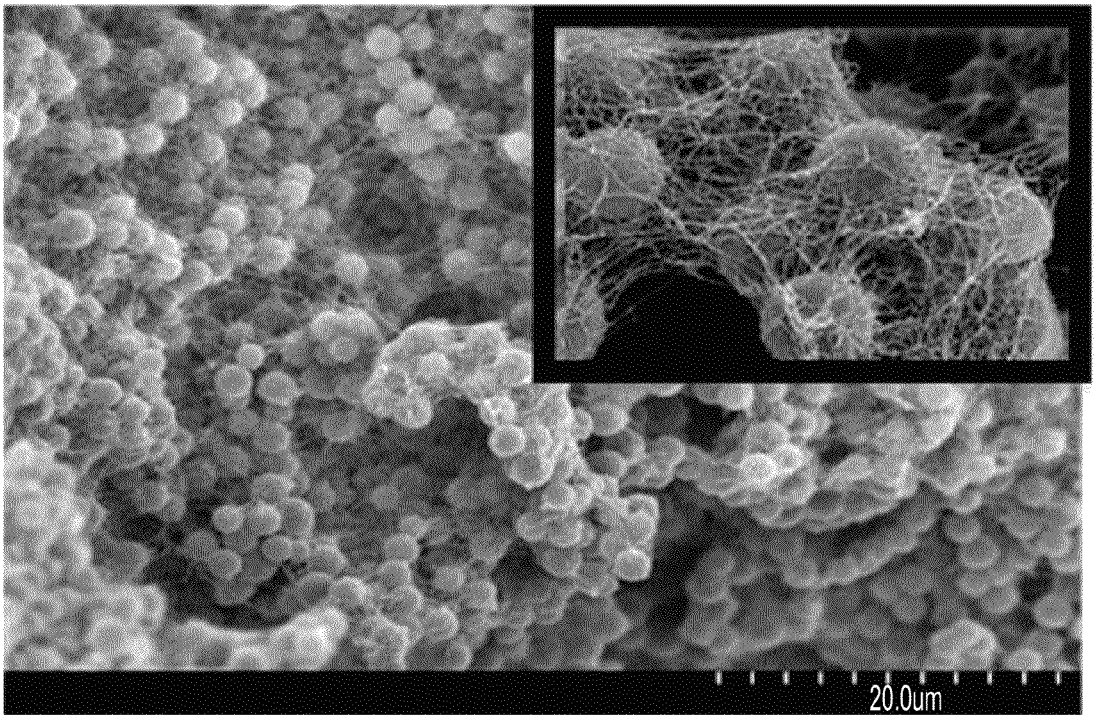
FIG. 2 is an SEM image of a nanostructured material in accordance with an embodiment of the invention.

Embodiments of the invention are directed to nano structured materials having pore sizes that are one or several orders of magnitude smaller than typical acoustic foams. Such nanoporous materials are formed by assemblies of individual nanoparticles with fractal structures. FIG. 2 shows a nanostructured material in accordance with an embodiment of the invention. In FIG. 2, a material having a density of 0.25 g/cm$^3$ comprises polyurea particles in the range of around 2 μm that are formed from nanoparticles, wherein the particles are connected by a nanofibrous polyurea web. As can be seen in the inset figure of FIG. 2, the individual particles are embedded in a spider web-like network of nanofibers.

In a further embodiment of the invention, a nanostructured material comprises silica particles, which are nanoencapsulated within a nanometer-thin polymer coating (e.g., polyurea, polystyrene, polymethylmethacrylate, polynorbornene). The silica particles range in diameter from 15 nm to 2 μm. The polymer coating confers ductility to the material. These polymer-crosslinked materials retain the high porosity (>90% v/v) and high surface area (>100 m$^2$/g) of the silica backbone, and are extremely strong and ductile.

This invention uses mechanically strong, low-cost, organic nanoporous materials, or organic/inorganic nanoporous materials for significant acoustic attenuation for structures, instruments, and devices (including hearing protection earplugs and earmuffs). These nanoporous materials are characterized by high surface area (>50 m$^2$/g) and high porosity (>50%). They are often classified as aerogels. Traditional inorganic aerogels are brittle. The aerogels used for acoustic attenuation have to be mechanically strong so that they can survive under noisy environment without developing cracks or other defects that lead to noise leaking through the defects. This invention distinguishes over the prior art in that the new method provides acoustic insulation using aerogels which are either purely organic nanoporous materials, or porous nanostructured inorganic/organic composites with significant noise attenuation at a level of 20 dB/cm or higher. The advantage of the proposed method is that it provides significant noise reduction using relatively thin materials, on the order of 1 cm or thinner. Nanoporous materials used in this application include aerogels with nanofibrous mesostructures, aerogels with nanoparticulate mesostructures, aerogels with nanoplatelet structures, and aerogels with mixed nanostructures (particulate, fibrous, platelet). Examples of such materials include polymeric aerogels such as polyurea aerogels, polyurethane aerogels, polyimide aerogels, polyolefin aerogels synthesized through phenol-formaldehyde or melamine-formaldehyde chemistries, polyamide aerogels and aerogels prepared through Ring Opening Metathesis Polymerization (ROMP), polyuria crosslinked silica aerogels, polyuria crosslinked vanadia aerogels. When the nanoporous materials in the form of plates, earplug, earmuffs, etc. are used in acoustic attenuation, the graded nanoporous materials with mass density changing continuously spatially can be used. One such case is that stiff nanoporous materials (associated with high mass density) are used for one face or both faces of a sound insulating plate while the density changes continuously from outer layer(s) from high density to low density in the interior of the plate.

Figure 3:
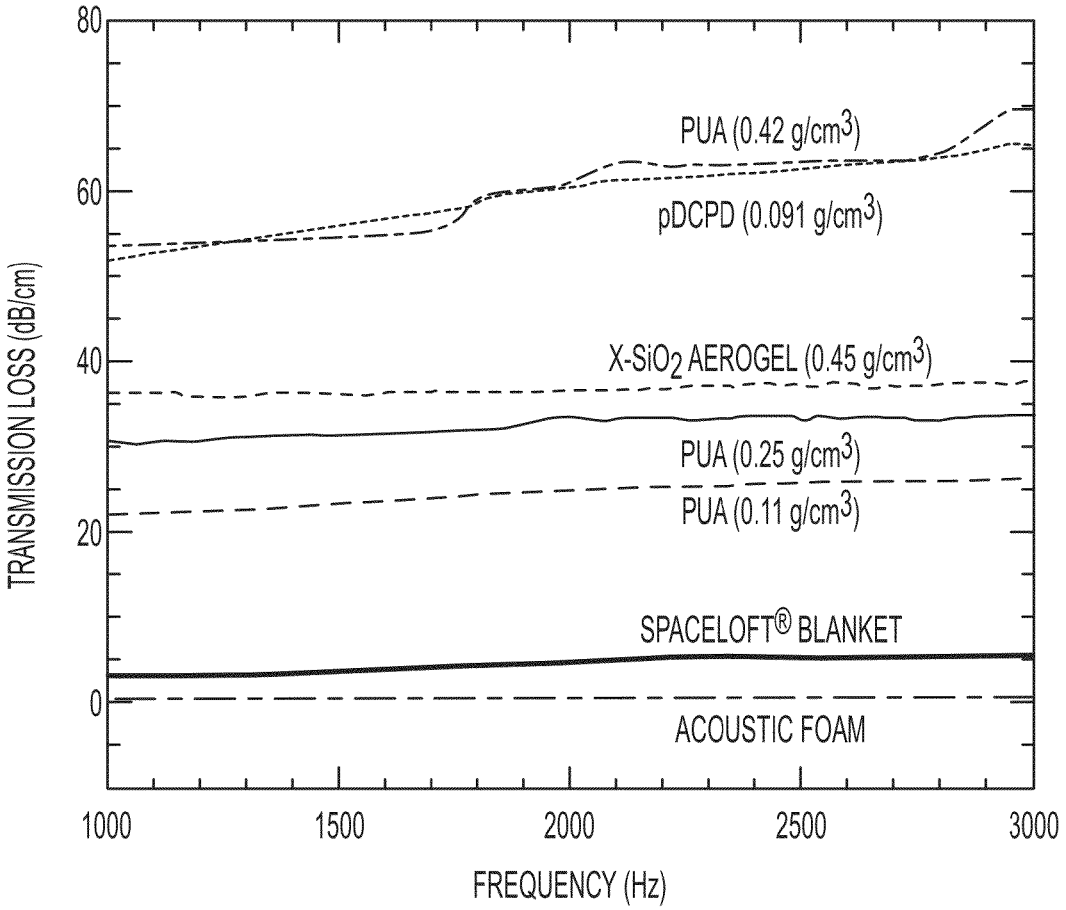
FIG. 3 shows an experimental comparison of the acoustic properties of several nanostrucured materials in accordance with an embodiment of the invention.

Embodiments of the invention are directed to materials that demonstrate acoustic attenuation ranging from about 20 dB/cm to about 50 dB/cm. In certain embodiments of the invention, the acoustic attentuation exhibited by a material of the claimed invention is greater than 50 dB/cm. FIG. 3 shows an experimental comparison of the acoustic properties of several polymeric and crosslinked nanostructured materials using a conventional acoustic impedance tube. 6 mm thick samples of the test materials were inserted between an incident chamber and a transmission chamber on a classical 4 cm diameter acoustic impedance tube. Sound wave with an intensity of 120 dB between 1000 Hz and 3000 Hz was supplied in the incident chamber. Over the frequency range measured, between 1000 and 3000 Hz, no transmission wave was detected. In order to increase the sensitivity of the test, the sample thickness was reduced to 2 mm and the transmission was measured. FIG. 3 shows the data from a representative experiment. A polyurea (PUA) aerogel having a density of 0.42 g/cm$^3$ that was tested showed a transmission loss of around 50-70 dB/cm; a polymer-crosslinked silica aerogel (X-MP4-T045) at 0.45 g/cm$^3$ showed a transmission loss of around 35-38 dB/com; a polydicyclopentadiene aerogel (pDCPD) at 0.091 g/cm$^3$ displayed a transmission loss of around 52-65 dB/cm. A lower density PUA aerogel having a density of 0.25 g/cm$^3$ and 0.11 g/cm$^3$ displayed acoustic transmission losses of around 30-34 dB/cm and 22-25 dB/cm respectively. For comparison purposes, the acoustic attenuation data was plotted with results from prior art materials such as Spaceloft® Blanket by Aspen Aerogels (2-5 dB/cm) consisting of traditional silica aerogel grains entrapped within glasswool fibers, and Acoustic Foam (0 dB/cm). The nanostructured aerogel materials of the claimed invention showed very high acoustic attenuation in transmission mode relative to currently available prior art materials. The results of the acoustic attenuation experiments in FIG. 3 are set forth in Table 1.

TABLE 1

| Aerogel Material | Density g/cc | Acoustic Transmission Loss (dB/cm) |
|---|---|---|
| PUA | 0.11 | 22-25 |
| PUA | 0.25 | 30-34 |
| PUA | 0.42 | 50-70 |
| pDCPD | 0.091 | 52-65 |
| Crosslinked $SiO_2$ | 0.45 | 35-38 |
| Spaceloft ® Blanket | — | 2-5 |
| Acoustic Foam | — | 0-3 |

As can be seen from Table 1, the acoustic attenuation properties of the aerogel materials are correlated to their densities. It is noteworthy that a material such as pDCPD exhibits the same acoustic attenuation as a PUA material while present at a density that is 5 times less than PUA. pDCPD-based aerogels thus serve as a good sound insulators based upon their acoustic attenuation properties.

Figure 4:
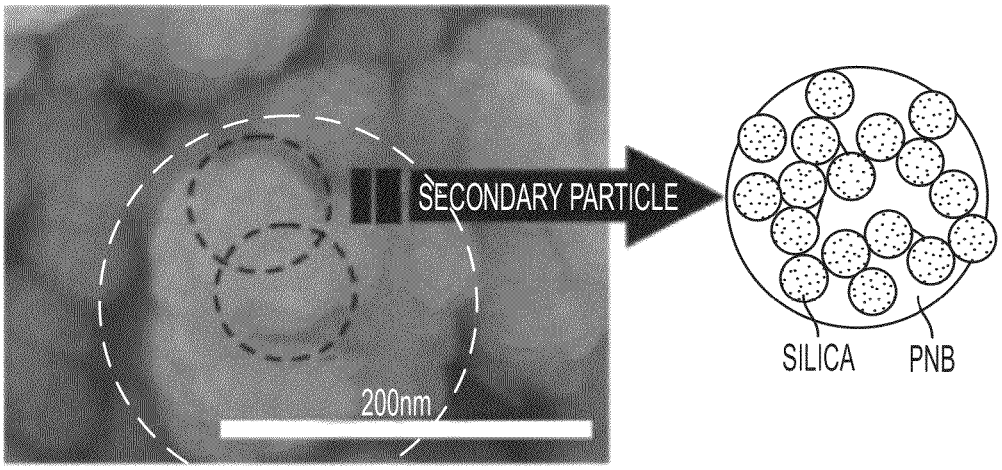
FIG. 4 shows a polymer cross-linked silica aerogel material in accordance with an embodiment of the invention.

FIG. 4 shows a polymer cross-linked silica aerogel material in accordance with an embodiment of the invention. In the SEM image, secondary particles are outlined in black dashes. A network of the secondary particles is indicated by the white dashed lines. A schematic representation of a single secondary particle is shown to the right of the SEM image. The secondary particle is composed of primary silica nanoparticles that are assembled and crosslinked with a polynorbornene (PNB) polymer.

Other embodiments of the invention are directed to the use of organic polyurea aerogels materials to form thin plates, or any shape as required in specific applications, where either space is limited for the materials to be deployed or the weight is limited. For example, taking a device (Magnetic Resonance Imaging (MRI) system) with a cylindrical shape cavity, where it is very noisy inside the cavity, the MRI device manufacture may wish to significantly reduce overall noise level by 20 dB or more. Around the cavity there are galvanic coils in which high electric current flows through to generate high-intensity magnet field. Between the galvanic coils and the cylindrical wall of the cavity, there is only a 2-3 centimeter gap for deploying any materials. Using traditional materials in this thin gap, one can only achieve noise level reduction by 3-7 dB, however deploying the polyurea aerogel materials of the claimed invention into this thin gap, a noise reduction as high as 20-40 dB can be achieved as seen in FIG. 3 and Table 1.

Another example where the materials of the claimed invention could be used would be in aircraft engines that generate high intensity noise. In the passenger cabins, in order to achieve low noise level induced by the aircraft engine, the aircraft cabin walls have to be thick, or heavy enough, which will lead to less payload and high gas consumption. When using the polyurea aerogel materials of the claimed invention, the excellent acoustic characteristics such as light-weight and high sound transmission loss, combined with high thermo-insolation can achieve low noise level as required by many aviation industrial manufacturers.

Certain of the nanostructured materials of the claimed invention are prepared in accordance with the methods set forth herein:

Monomers Desmodur N3300A triisocyanate, Desmodur RE triisocyanate, Desmodur N3200 diisocyanate, toluene diisocyanate (Mondur TD) and MDI (Mondur CD) were donated generously from Bayer Corporation. All monomers except Desmodur RE are supplied in neat form and were used as received. Desmodur RE is supplied as a solution in ethyl acetate, which was removed with a rotary evaporator before use.

Anhydrous acetone was produced from lower grade solvent by distilling over $P_2O_5$. Triethylamine (99% pure) was purchased from ACROS and was distilled before use.

Polyurea aerogels of different densities were prepared by varying the concentration of the monomer by first dissolving either 1.375 g, 2.75 g, 5.5 g, 11.0 g, 16.5 g or 33 g of Desmodur N3300A in a constant volume (94 ml) of dry acetone. Subsequently, for each monomer concentration 1.5, 3.0 or 4.5 mol equivalents of water was added, and sols were obtained by adding triethylamine at either 0.3%, 0.6% or 0.9% w/w relative to the total weight of the isocyanate monomer plus solvent. The final N3300A monomer concentrations were approximately 0.029 M, 0.056 M, 0.11 M, 0.21 M, 0.30 M or 0.52 M. Thus, in a typical procedure, 1.375 g (0.0028 mol) of N3300A was dissolved in 94 mL of dry acetone, 1.5 mol equivalents of water (0.073 mL, 0.0042 mol) was added and finally the sol was obtained by adding 0.26 mL of triethylamine (0.3% w/w as defined above). The sol was shaken vigorously and it was poured into polypropylene syringes used as molds (AirTite Norm-Ject syringes without needles purchased from Fisher, Part No. 14-817-31, 1.40 mm I.D.). The top part of the syringes was cut off with a razor blade and, after the syringes were filled with the sol, it was covered with multiple layers of Parafilm™ and solutions were left to gel. The particular sol of our example gelled in approximately 24 h. The gelation time (defined as the point when a sol does not move by mild shaking) depends on the concentration of the monomer, water and the catalyst and varies from 24 h to approximately 5 min (at the highest concentrations of all three). For direct comparison, gels with other isocyanates (Desmodur RE, Desmodur N3200 and Mondur TD) were formulated by varying the amount of the monomer in such a way that the final molar concentrations of the monomers in the sols would be about equal to those used for N3300A. With Desmodur RE triisocyanate it was possible to obtain gels over the entire concentration range used with Desmodur N3300A. Gels from Desmodur N3200 and Mondur TD were obtained only for monomer concentrations above ~0.20 M. All gels were aged for a day. Subsequently, gels were removed from their molds and were placed individually into fresh acetone, approximately 4× the volume of each gel. The solvent was changed two more times every 24 h. Finally, wet-gels were dried into PUA aerogels with liquid $CO_2$ in an autoclave, taken out at the end as a SCF. Alternatively, xerogels were obtained by ambient drying of acetone-filled wet-gels, while aerogel-like materials were prepared from the two highest density samples, followed by drying at 40° C. under ambient pressure. Variable-density PUA aerogels were synthesized by filling syringe molds, similar to those described above, with a high concentration sol (e.g., [N3300A]=0.52 M), which was simultaneously and constantly diluted using a second pump with a low concentration sol (e.g., [N33Q0A]=0.109 M). For this we used two MINI-PUMP Variable Flow pumps, Model Number 13-876-2 (capable of delivering 0.4-85 ml min" 1) purchased from Fischer Scientific and run at 11 mL min" 1. The high-concentration sol container was stirred continuously with a magnetic stirrer. The resulting sols became hazy and gelled progressively from the bottom up. The resulting gels were removed from the molds and were processed in a similar fashion to the uniform density samples. The variable density was confirmed with NMR imaging (MRS) and direct measurement by cutting disks along the axis of the aerogel. Variable-density samples were tested for flammability by igniting them from the low-density end as described below. Drying with SCF CO2 was conducted in an autoclave (SPI-DRY Jumbo Critical Point Dryer, SPI Supplies, Inc., West Chester, Pa.). Samples submerged in the last wash solvent were loaded in the autoclave and were extracted at 14° C. with liquid $CO_2$ until no more solvent (acetone) was washed off. Then the temperature of the autoclave was raised above the critical point of $CO_2$ (32° C., 73.8 bar), and the pressure was released isothermally at 40° C.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. An acoustic attenuating composition, wherein the composition comprises primary particles and secondary particles, wherein said secondary particles are composed of the primary particles and the secondary particles are embedded in a network of nanofibers and the composition contains pores ranging in size from less than 10 nm to more than one micron in diameter and further wherein the composition exhibits acoustic transmission loss ranging from 20 to 60 dB/cm thickness of the composition.

2. The composition of claim 1, wherein the composition further comprises a coating in which the secondary particles are embedded, wherein the coating comprises a polymer.

3. The composition of claim 1, wherein the primary particles are nanoparticles.

4. The composition of claim 3, wherein the nanoparticles are composed of silica.

5. The composition of claim 2, wherein the polymer is selected from polyurea, polymethyl methacrylate, polystyrene and polynorbornene.

6. The composition of claim 1, wherein the primary particle has a diameter ranging from 1 to 2 nm.

7. The composition of claim 1, wherein the secondary particle has a diameter ranging from 15 nm to 2 μm.

8. An article of manufacture comprising the composition of claim 1.

9. The article of claim 8, wherein said article is a sound insulator.

10. The article of claim 9, wherein said article is used in earplugs, earmuffs, building materials, vehicle bodies, aircrafts and appliances.

11. A sound absorbing member comprising a composition wherein the composition comprises primary particles and secondary particles, wherein said secondary particles are composed of the primary particles and the secondary particles are embedded in a network of nanofibers and the composition contains pores ranging in size from less than 10 nm to more than one micron in diameter and further wherein the composition exhibits acoustic transmission loss ranging from 20 to 60 dB/cm thickness of the composition.

12. The sound absorbing member of claim 11, wherein the composition further comprises a coating in which the secondary particles are embedded, wherein the coating comprises a polymer.

13. The sound absorbing member of claim 11, wherein the primary particles are nanoparticles.

14. The sound absorbing member of claim 13, wherein the nanoparticles are composed of silica.

15. The sound absorbing member of claim 12, wherein the polymer is selected from polyurea, polymethyl methacrylate, polystyrene and polynorbornene.

16. The sound absorbing member of claim 11, wherein the primary particle has a diameter ranging from 1 to 2 nm.

17. The sound absorbing member of claim 11, wherein the secondary particle has a diameter ranging from 15 nm to 2 μm.

* * * * *